US008422936B2

(12) United States Patent
Hirata

(10) Patent No.: US 8,422,936 B2
(45) Date of Patent: Apr. 16, 2013

(54) IMAGE FORMING SYSTEM FOR ENSURING HIGH PRODUCTIVITY CORRESPONDING TO IMPROVED SPEED OF CONTINUOUS PRINTING

(75) Inventor: Tetsuo Hirata, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 259 days.

(21) Appl. No.: 12/828,371

(22) Filed: Jul. 1, 2010

(65) Prior Publication Data

US 2011/0002722 A1 Jan. 6, 2011

(30) Foreign Application Priority Data

Jul. 3, 2009 (JP) ..... 2009-158350

(51) Int. Cl.
*G03G 15/00* (2006.01)

(52) U.S. Cl.
USPC ..... 399/407; 399/408; 399/396

(58) Field of Classification Search ..... 399/407–410, 399/396
See application file for complete search history.

(56) References Cited

U.S. PATENT DOCUMENTS 6,973,286 B2 * 12/2005 Mandel et al. ..... 399/391
7,894,739 B2 * 2/2011 Gramowski et al. ..... 399/82

FOREIGN PATENT DOCUMENTS

JP 11208979 A * 8/1999
JP 2003-312934 A 11/2003
JP 2004-205772 A 7/2004
JP 2006-053235 A 2/2006

OTHER PUBLICATIONS

Japanese Office Action dated Jan. 29, 2013 (and English translation thereof) in counterpart Japanese Application No. 2009-158350.

* cited by examiner

*Primary Examiner* — Judy Nguyen
*Assistant Examiner* — Justin Olamit
(74) *Attorney, Agent, or Firm* — Holtz, Holtz, Goodman & Chick, P.C.

(57) ABSTRACT

Disclosed is an image forming system including: an image forming apparatus; finishing apparatuses; and a conveyance unit apparatus; wherein the image forming apparatus include: a control section to judge which of the finishing apparatuses performs finishing and to transmit a judgment result to the conveyance unit apparatus, and the conveyance unit apparatus includes: placement sections, a conveyance path, discharging sections, discharging-section switching sections among which a discharging-section switching section corresponding to a discharging section discharging the sheet is switched, and a control section which judges the discharging section as discharging the sheet based on the judgment result and which switches the discharging-section switching section so that the sheet is discharged to the judged discharging section.

5 Claims, 11 Drawing Sheets

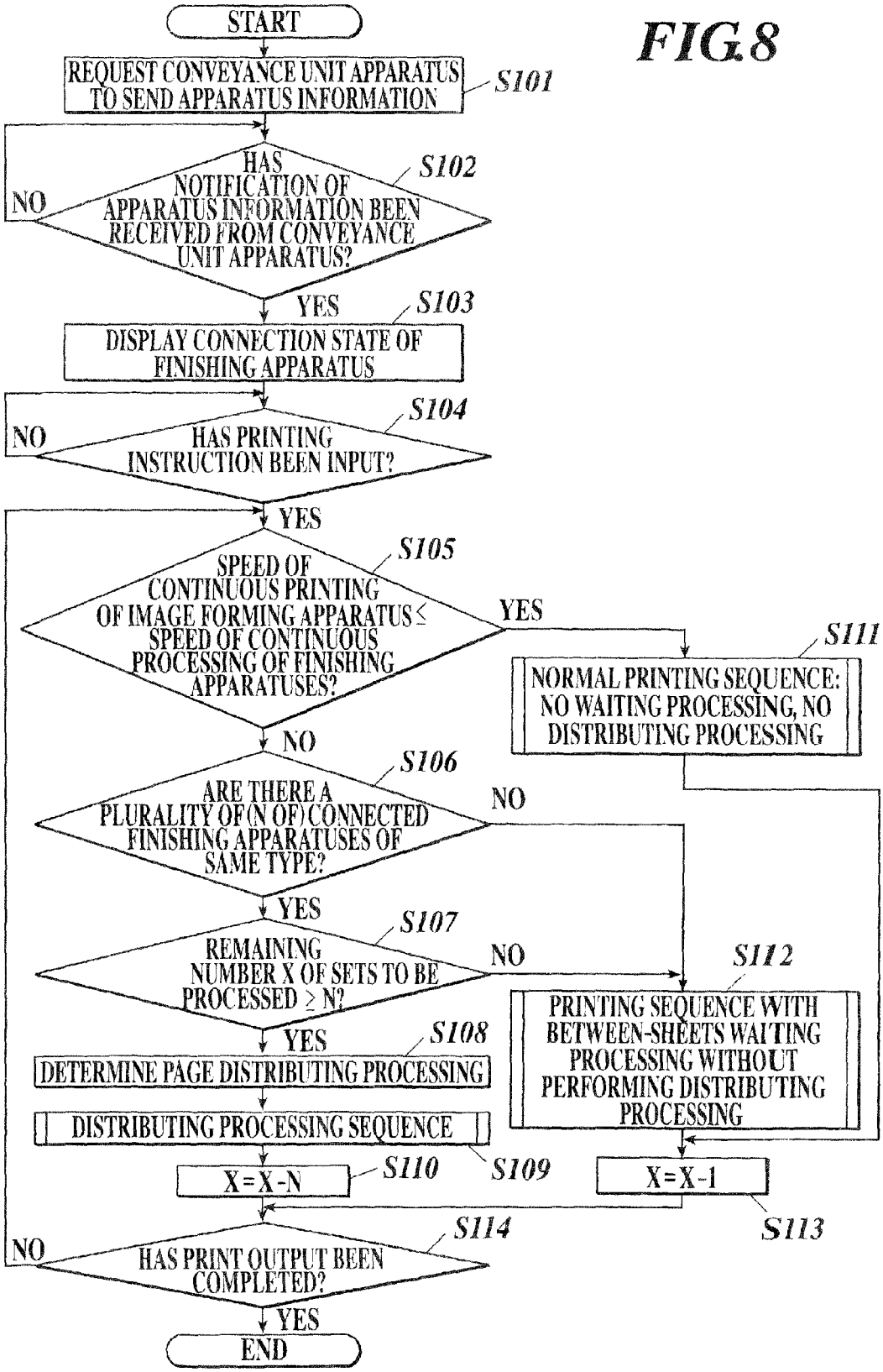
FIG.8
START
REQUEST CONVEYANCE UNIT APPARATUS TO SEND APPARATUS INFORMATION
S101
HAS NOTIFICATION OF APPARATUS INFORMATION BEEN RECEIVED FROM CONVEYANCE UNIT APPARATUS?
S102
NO
YES
DISPLAY CONNECTION STATE OF FINISHING APPARATUS
S103
HAS PRINTING INSTRUCTION BEEN INPUT?
S104
NO
YES
SPEED OF CONTINUOUS PRINTING OF IMAGE FORMING APPARATUS ≤ SPEED OF CONTINUOUS PROCESSING OF FINISHING APPARATUSES?
S105
YES
NORMAL PRINTING SEQUENCE: NO WAITING PROCESSING, NO DISTRIBUTING PROCESSING
S111
NO
ARE THERE A PLURALITY OF (N OF) CONNECTED FINISHING APPARATUSES OF SAME TYPE?
S106
NO
YES
REMAINING NUMBER X OF SETS TO BE PROCESSED ≥ N?
S107
NO
S112
PRINTING SEQUENCE WITH BETWEEN-SHEETS WAITING PROCESSING WITHOUT PERFORMING DISTRIBUTING PROCESSING
YES
S108
DETERMINE PAGE DISTRIBUTING PROCESSING
DISTRIBUTING PROCESSING SEQUENCE
S109
X=X-N
S110
X=X-1
S113
HAS PRINT OUTPUT BEEN COMPLETED?
S114
NO
YES
END

IMAGE FORMING SYSTEM FOR ENSURING HIGH PRODUCTIVITY CORRESPONDING TO IMPROVED SPEED OF CONTINUOUS PRINTING

BACKGROUND

1. Field of the Invention

The present invention relates to an image forming system.

2. Description of Related Art

Recently, a speed of continuous printing of an image forming apparatus has been improved. With this speed improvement, speeds of various finishings such as staple processing and binding processing in a finishing apparatus also need to be improved. In order to perform finishings corresponding to the speed of continuous printing of the image forming apparatus, a user needs to connect a highly-functional finishing apparatus thereto. For example, when a user uses an image forming apparatus whose speed of continuous printing is 40 ppm and then newly buys an image forming apparatus whose speed of continuous printing is 120 ppm, unless the user connects a finishing apparatus having a finishing speed corresponding to the speed of continuous printing of the new image forming apparatus thereto, finishing cannot keep up with the speed of continuous printing and productivity cannot be improved. For ensuring high productivity, an image forming system in which a plurality of finishing apparatuses are connected to one image forming apparatus in series has been invented.

Cited document 1 (Japanese Patent Application Laid-open Publication No. 2003-312934) discloses a finishing apparatus in which each function to execute finishing is modularized and respective modules are detachably/attachably connected to one finishing apparatus in parallel with one another, and which includes a sheet distributing member to switch a sheet conveyance path for a given module depending on user's intended use.

Cited document 2 (Japanese Patent Application Laid-open Publication No. 2004-205772) discloses an image forming system which makes finishings more efficient by connecting two finishing apparatuses so that they perform finishings alternately.

SUMMARY

However, though the finishing apparatus described in cited document 1 can perform finishing based on the module selected by the sheet distributing member to a sheet conveyed from the image forming apparatus, the finishing apparatus cannot perform finishing corresponding to the speed of continuous printing of the image forming apparatus when a processing speed of the connected finishing apparatuses are lower than the speed of continuous printing of the image forming apparatus. As a result, productivity cannot be improved. In addition, when a serious failure bringing a service call occurs in any of the finishing apparatuses, the whole of the image forming apparatus cannot be used, and this may increase a downtime. The same can be said for the image forming system described in cited document 2. Although the image forming system can make two finishing apparatuses perform finishings alternately, high productivity corresponding to the improved speed of continuous printing of the image forming apparatus cannot be ensured.

According to the first aspect of the present invention, there is provided an image forming system including:

an image forming apparatus to form an image on a sheet;

a plurality of finishing apparatuses each of which perform finishing to the sheet image-formed by the image forming apparatus to discharge the sheet; and a conveyance unit apparatus to which each of the image forming apparatus and the respective finishing apparatuses is connected; wherein the image forming apparatus includes:

a control section to judge which of the finishing apparatuses performs the finishing to the sheet on the basis of a previously-determined method to transmit a judgment result to the conveyance unit apparatus when a number of sets to be output according to a job to be executed is plural and when a plurality of the finishing apparatuses each of which can perform finishing corresponding to the job are connected to the conveyance unit apparatus, and the conveyance unit apparatus includes:

a plurality of placement sections in which the plurality of finishing apparatuses can be placed respectively, a conveyance path along which the sheet image-formed by the image forming apparatus is conveyed, a plurality of discharging sections provided in the placement sections respectively, which discharging sections discharge the sheet conveyed along the conveyance path to the finishing apparatuses respectively placed in the placement sections, one or more discharging-section switching sections among which a discharging-section switching section corresponding to a discharging section discharging the sheet conveyed along the conveyance path among the plurality of discharging sections is switched, and a control section to judge the discharging section which discharges the sheet on the basis of the judgment result received from the control section of the image forming apparatus to switch the discharging-section switching section so that the sheet is discharged to the judged discharging section.

BRIEF DESCRIPTION OF THE DRAWINGS

The present invention will become more fully understood from the detailed description given hereinbelow and the appended drawings which given by way of illustration only, and thus are not intended as a definition of the limits of the present invention, and wherein:

FIG. 8 is a flowchart showing processing by the image forming system according to the embodiment;

DETAILED DESCRIPTION OF THE PREFERRED EMBODIMENT

In the following, a configuration of an image forming system according to the present invention will be described with reference to the drawings.

Figure 1:
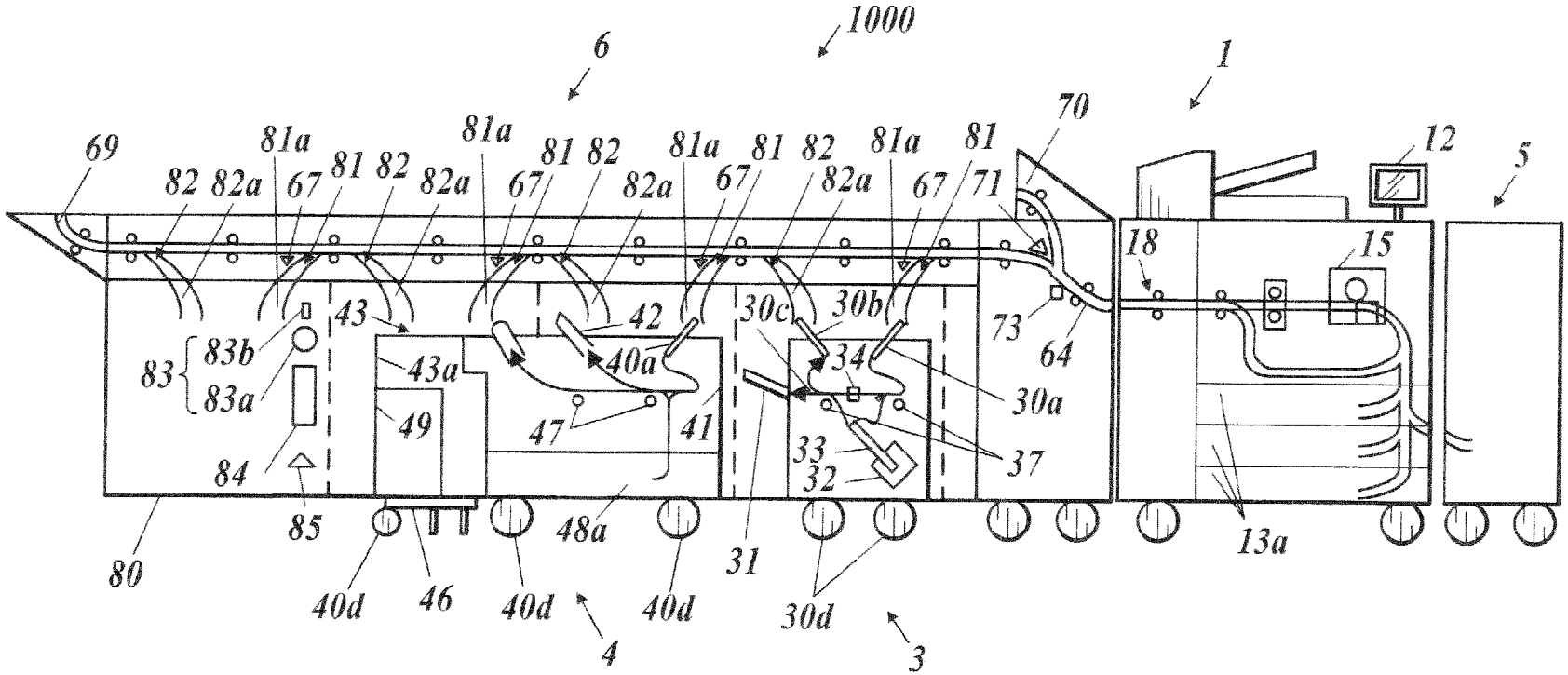
FIG. 1 is an overall view of an image forming system according to the present embodiment.

FIG. 1 is an overall view showing a whole configuration of an image forming system according to the embodiment of the present invention.

An image forming system 1000 includes an image forming apparatus 1, a feeding unit 5, a conveyance unit apparatus 6, a first finishing apparatus 3, and a second finishing apparatus 4. Incidentally, though details will be described later, the configuration is not limited to the example shown in FIG. 1, and a plurality of finishing apparatuses of arbitrary types may be connected to the conveyance unit apparatus 6.

The image forming apparatus is an apparatus to form an image/images on a sheet/sheets, and as shown in FIG. 1, configured to include an operation section 12, a feeding tray 13*a*, an image forming section 15, and a conveyance section 18, and so on.

The operation section 12 is configured to include a Liquid Crystal Display (LCD), various operation keys such as a start button for instructing to start printing, a touch panel integrally formed with the LCD, and so on. The operation section 12 displays various operation buttons, a state of each apparatus constituting the image forming system 1000, an operation state of each function and the like on the LCD, and outputs an operation signal corresponding to depressing operation onto the operation keys or pressing operation on the touch panel by a user to an image-forming-apparatus control section 100 to be hereinafter described, according to a control signal input from the image-forming-apparatus control section 100.

In addition, via the operation section 12, a user can set various finishings (punching processing, folding processing, staple processing, shift processing, case binding processing, and so on) and a sheet size (A4, B5 or the like).

The feeding tray 13*a* houses sheets, on which images are to be transferred (formed) respectively, by sheet size or sheet kind, similarly to the feeding unit 5. The feeding tray 13*a* is configured to feed the sheets to an image forming section 15 to be hereinafter described.

The image forming section 15 is composed of: a photosensitive drum on which an electrostatic latent image is formed; a charging device to uniformly charge the photosensitive drum; a laser unit to irradiate a surface of the uniformly-charged photosensitive drum with laser light which is turned ON/OFF depending on image data to form the electrostatic latent image; a developing device to visualize the electrostatic latent image to be a toner image; a transferring/detaching device to transfer the toner image on the surface of the photosensitive drum onto the conveyed sheet and then detach the sheet from the surface of the photosensitive drum; a cleaning device to remove toner which remains on the surface of the photosensitive drum after transferring; a fixing device to heat/pressurize the toner image on the sheet to fix the toner image, and so on. The image forming section 15 forms the image on the sheet on a job basis by an electrophotography system according to a control signal input from the image-forming-apparatus control section 100. The sheet on which the toner has been fixed is conveyed to the conveyance unit apparatus 6 by the conveyance section 18.

The conveyance section 18 is composed of a conveyance roller and a conveyance belt, and a motor to drive them, and so on. The conveyance section 18 conveys the sheets housed in the feeding tray 13*a* or the feeding unit 5 along a conveyance path to discharge the sheets to the conveyance unit apparatus 6 according to the control signal input from the image-forming-apparatus control section 100. The conveyance section 18 also includes a sensor to detect completion of sheet discharge to the conveyance unit apparatus 6, and transmits a corresponding signal when sheet discharge from the image forming apparatus 1 is completed.

The feeding unit 5 houses the sheets by a size of each sheet on which the image is to be formed, similarly to the feeding tray 13*a*. The feeding unit 5 feeds the sheets to the image forming section 15.

Figure 2:
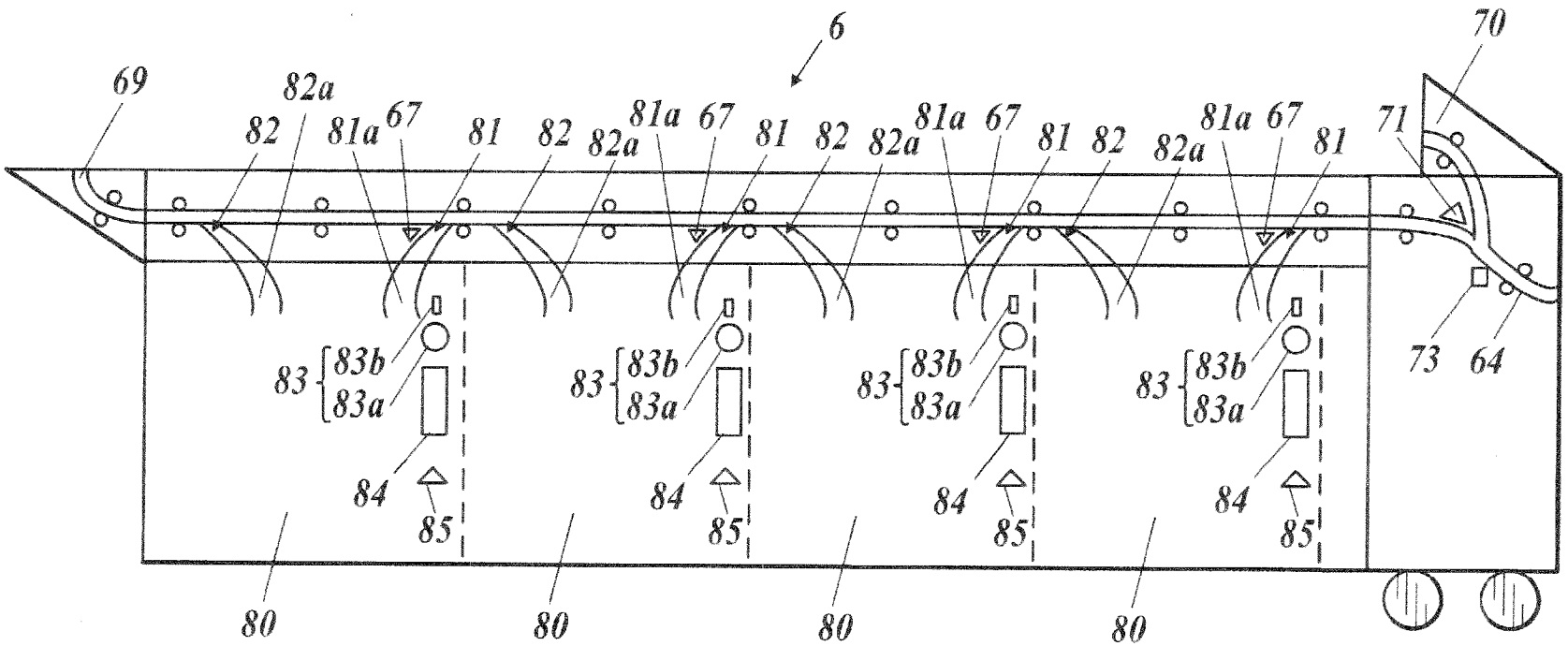
FIG. 2 is a front view showing a schematic configuration of a conveyance unit apparatus constituting the image forming system according to the embodiment.

FIG. 2 is a front view showing a schematic configuration of the conveyance unit apparatus constituting the image forming system according to the embodiment of the present invention.

As shown in FIG. 2, the conveyance unit apparatus 6 is configured to include a conveyance path 64, a sheet detection sensor 73, a conveyance-path switching plate 71, a plurality of discharging-section switching plates 67, an upper-stream-side delivery section 70, a down-stream-side delivery section 69, a plurality of placement sections 80, and so on.

The conveyance path 64 receives the sheets discharged from the conveyance section 18 of the image forming section 1 to convey the sheet to the down-stream-side delivery section 69 or the upper-stream-side delivery section 70. The conveyance path 64 has an openable and closable door (not-shown) on the upper side thereof, and makes the door open when a sheet jam or the like occurs during sheet conveyance along the conveyance path 64 so that recovery operations can be performed easily.

The sheet detection sensor 73 outputs an ON/OFF signal when the sheet is received by the conveyance path 64 and passes a position where the sensor is placed. The sheet detection sensor 73 is configured to output the signal output from the sheet detection sensor 73 to a conveyance-unit-apparatus control section 600 to be hereinafter described. The conveyance-unit-apparatus control section 600 can detect that the conveyance unit apparatus 6 receives the sheets by receiving this output signal.

The conveyance-path switching plate 71 can be switched so that the sheets conveyed along the conveyance path 64 are conveyed to one of the down-stream-side delivery section 69 and the upper-stream-side delivery section 70.

The discharging-section switching plates 67 respectively function as discharging-section switching sections and can be switched so that the sheets conveyed along the conveyance path 64 are discharged to one of or any of discharging sections 81 of placement sections 80 to be hereinafter described. The discharging-section switching plates 67 are provided in the placement sections 80 respectively, and one or more of the plurality of discharging-section switching plates 67 can be arbitrarily switched according to the control signal from the conveyance-unit-apparatus control section 600.

The upper-stream-side delivery section 70 is provided on the upper stream side of the conveyance unit apparatus 6, and discharges the sheets for which finishings are unnecessary, or the subsequent sheets when the sheet jam or the like occurs in the finishing apparatuses respectively placed in the placement sections 80, among the sheets conveyed along the conveyance path 64.

The down-stream-side delivery section 69 is provided on the down-stream-side end portion of the conveyance unit apparatus 6, and discharges the sheets to be subjected to finishing by the finishing apparatuses respectively placed in the placement sections 80 among the sheets image-formed by the image forming apparatus 1 and conveyed along the conveyance path 64. The down-stream-side delivery section 69 also functions as an alternate outlet such as a sheet discharge tray of the upper-stream-side delivery section 70 or the finishing apparatuses for discharging the subsequent sheets when the sheet jam or the like occurs in the upper-stream-side delivery section 70 or the finishing apparatuses respectively placed in the placement sections 80.

The plurality of (for example, four) placement sections 80 are provided over an area from the upper stream side to the down stream side of the conveyance unit apparatus 6, and each of the placement sections 80 includes the discharging section 81, a bringing-in section 82, a attaching/detaching section 83, a connector 84 and a connection detecting section 85. The finishing apparatuses are directly, namely without other finishing apparatus between each finishing apparatus and the conveyance unit apparatus 6, placed in the conveyance unit apparatus 6. The number of the placement sections 80 is arbitrary, and not especially limited. For example, the number of the placement sections 80 may be five.

The discharging section 81 includes a gate 81*a* which can be connected to an introducing port (for example, introducing port 30*a* or 40*a*) of the finishing apparatuses respectively placed in the placement sections 80, conveyance rollers (not shown), and so on. The sheets conveyed along the conveyance path 64 are introduced to each of the finishing apparatuses through the gate 81*a* and the conveyance rollers.

The bringing-in section 82 includes a gate 82*a* which can be connected to a leading-out port (for example, a leading-out port 30*b* of the first finishing apparatus 3) of the finishing apparatus including the leading-out port in each of the finishing apparatuses respectively placed in the placement sections 80, conveyance rollers (not shown), and so on. The bringing-in section 82 brings the sheets which have been introduced to each of the finishing apparatuses by the discharging section 81 and to which finishing has been performed in the conveyance path 64 again through the gate 82*a* and the conveyance rollers.

The attaching/detaching section 83 is composed of a pin joint hole 83*a*, a solenoid 83*b*, and so on.

The pin join hole 83*a* fits together with a mounting pin (for example, a mounting pin 30*f* or 40*f* to be hereinafter described) of each of the finishing apparatuses respectively placed in the placement sections 80, and enables each of the finishing apparatuses to be detachable and attachable. The pin join hole 83*a* includes a penetrating slot (not shown) through which a plunger of the solenoid 83*b* penetrates, the slot being formed from the upper side to the lower side of the pin join hole 83*a*.

The solenoid 83*b* includes the plunger (not shown) which straightly drives up and down when current flows, and configured to penetrate both penetrating slots of the mounting pin and the pin join hole 83*a* from the upper part to the lower part while the mounting pin fits together with the pin join hole 83*a*.

The connector 84 is a power source connector and connected to a power source connector (for example, a connector 30*g* or connector 40*g*) of each of the finishing apparatuses respectively placed in the placement sections 80 so as to supply power to the finishing apparatuses.

The connection detection sensor 85 detects attachment/detachment of each of the finishing apparatuses to each of the placement sections 80 by a noncontact detecting means such as light and magnetism, for example.

The conveyance-unit-apparatus control section 600 to be hereinafter described can confirm connection states of the finishing apparatuses by an output signal from each of the connection detection sensors 85.

Figure 3A:
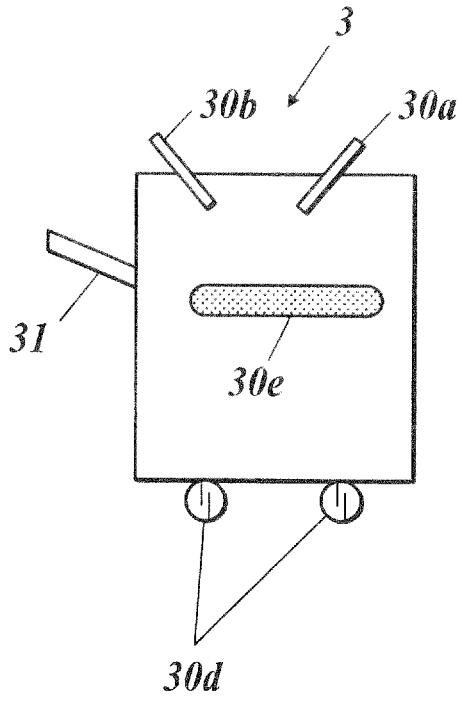
FIG. 3A is a front view for explaining about a first finishing apparatus constituting the image forming system according to the embodiment.
Figure 3B:
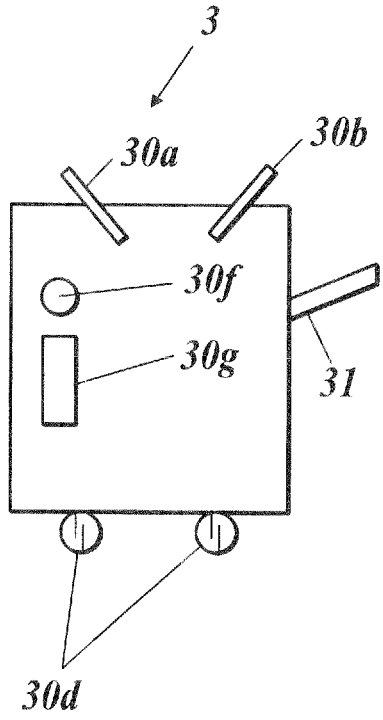
FIG. 3B is a rear view for explaining about the first finishing apparatus constituting the image forming system according to the embodiment.

FIGS. 3A and 3B are diagrams for explaining about a certain kind of the finishing apparatus (the first finishing apparatus 3 shown in FIGS. 1, 3A and 3B is assumed to be the finishing apparatus of "type A") which constitutes the image forming system according to the embodiment of the present invention. FIG. 3A is a front view, and FIG. 3B is a rear view. In the embodiment, types of the finishing apparatuses connected to the conveyance unit apparatus 6 are classified according to a content of each finishing executable by the finishing apparatuses. For example, the finishing apparatuses are classified such that the finishing apparatuses which can perform side stitching are classified into type A and the finishing apparatuses which can perform case binding are classified into type B, for example. The types of the finishing apparatuses are not limited as long as they are classified according to a previously-determined rule. For example, the finishing apparatuses whose finishing contents and processing speeds are same as each other respectively can be classified into the same type. A memory (not shown) of each of the finishing apparatuses stores information indicating its type, and the image-forming-apparatus control section 100 and the conveyance-unit-apparatus control section 600 obtain this information to determine each type of each of the finishing apparatuses connected to the conveyance unit apparatus 6.

The first finishing apparatus 3 of type A is, as shown in FIGS. 1, 3A and 3B, configured to include a sheet discharge tray 31, the introducing port 30*a*, the leading-out port 30*b*, a conveyance-path switching plate 30*c*, a staple processing section 32, a stacker 33, a shift processing section 34, a wheel section 30*d*, sheet-jam detection sensors 37, a handle 30*e*, the mounting pin 30*f*, and the connector 30*g*. The first finishing apparatus 3 can perform staple processing or shift processing, and side binding, as finishings to the sheet conveyed from the conveyance unit apparatus 6.

The sheet discharge tray 31 discharges the sheet to which staple processing or shift processing has been performed.

The introducing port 30*a* is connected to the discharging section 81 of the conveyance unit apparatus 6, and introduces the sheets conveyed from the discharging section 81 to convey the sheets to the staple processing section 32 or the shift processing section 34. The introducing port 30*a* is provided with a sensor to detect an end of introducing the sheet, and generates a signal indicating completion of sheet discharge from the conveyance unit apparatus 6 to the first finishing apparatus 3.

The leading-out port 30*b* is connected to the bringing-in section 82 of the conveyance unit apparatus 6, and makes the conveyance path 64 of the conveyance unit apparatus 6 receive the sheet to which the staple processing or shift processing has been performed by the staple processing section 32 or the shift processing section 34.

The conveyance-path switching plate 30*c* switches the conveyance path so that the sheet conveyed from the staple processing section 32 or the shift processing section 34 is conveyed to one of the sheet discharge tray 31 and the leading-out port 30*b*.

The staple processing section 32 performs staple processing to the sheet by injecting staples into two points on a marginal portion of the sheet.

The stacker 33 makes a plurality of sheets to which staple processing is performed by the staple processing section 32 to be accumulated.

The shift processing section 34 performs shift processing to change a position to which the sheet is discharged at every predetermined number of pages.

The wheel section 30*d* includes casters, in which wheels can whirl freely according to a moving direction.

The sheet-jam detection sensors 37 are provided at multiple portions along the sheet conveyance path, and when detecting the sheet jam in the conveyance path, outputs sheet-jam information composed of an output signal thereof to the conveyance-unit-apparatus control section 600 through a serial communication section 301 to be hereinafter described.

The handle 30*e* is a pull handle, which is pulled when detaching the first finishing apparatus 3 from the conveyance unit apparatus 6. Since the wheel section 30*d* whirls in the pulling direction, the handle 30*e* enables conveyance of the first finishing apparatus 3.

The mounting pin 30*f* fits together with the pin join hole 83*a* of the conveyance unit apparatus 6, and enables attachment/detachment of the first finishing apparatus 3 and the conveyance unit apparatus 6. The mounting pin 30*f* includes a penetrating slot (not shown) through which a plunger of the solenoid 83*b* penetrates, the penetrating slot being formed from the upper side to the lower side of the mounting pin 30*f*, while the mounting pin 30*f* fits together with the pin join hole 83*a*.

The connector 30*g* is a power source connector, and connected to the connector 84 of the conveyance unit apparatus 6 to receive power supply from the conveyance unit apparatus 6. The first finishing apparatus 3 starts power supply from the conveyance, unit apparatus 6 via the connector 30*g* according to an instruction from the conveyance-unit-apparatus control section 600. When power is supplied to each section of the first finishing apparatus 3 and preparation of finishing is completed, a signal indicating completion of preparation is transmitted to the conveyance-unit-apparatus control section 600.

Figure 4A:
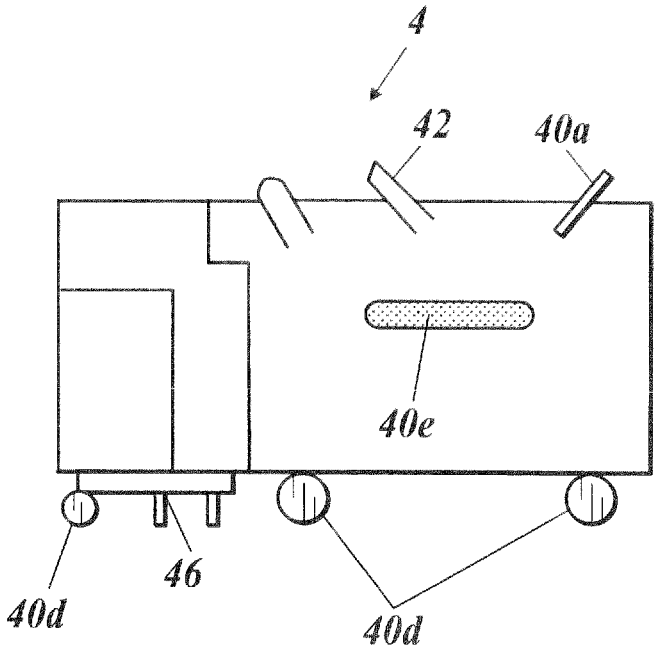
FIG. 4A is a front view for explaining about a second finishing apparatus constituting the image forming system according to the embodiment.
Figure 4B:
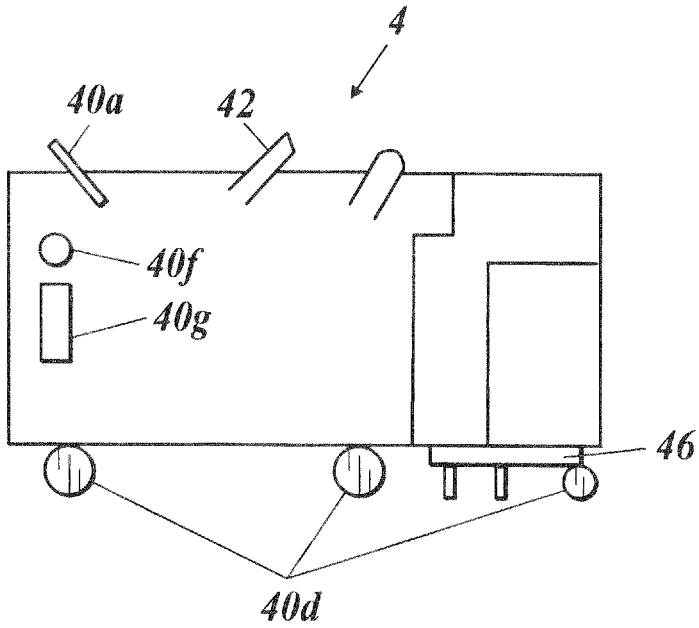
FIG. 4B is a rear view for explaining about the second finishing apparatus constituting the image forming system according to the embodiment.

FIGS. 4A and 4B are diagrams for explaining the finishing apparatus of a certain type (assumed to be "type B") which constitutes the image forming system according to the embodiment of the present invention. FIG. 4A is a front view, and FIG. 4B is a rear view.

As shown in FIGS. 1, 4A and 4B, the second finishing apparatus 4 of type B is configured to include a sheet discharge tray 42, the introducing port 40*a*, a bookbinding section 41, a book accumulation section 43, a moving wagon 46, a front-cover-sheet housing section 48*a*, sheet-jam detection sensors 47, a wheel section 40*d*, a handle 40*e*, the mounting pin 40*f*, the connector 40*g*, and so on. The second finishing apparatus 4 can perform case binding as finishing to the sheets conveyed from the conveyance unit apparatus 6.

The sheet discharge tray 42 can discharge the sheets to which finishing has been performed by the second finishing apparatus 4 of type B.

The introducing port 40*a* is connected to the discharging section 81 of the conveyance unit apparatus 6, and introduces the sheets discharged from the discharging section 81. The introducing port 40*a* is provided with a sensor to detect an end of introducing the sheets, and generates a signal indicating that sheet discharge from the conveyance unit apparatus 6 to the second finishing apparatus 4 of type B has been completed.

The bookbinding section 41 applies paste to a sheet bundle, and envelops the sheet bundle with the front cover sheet supplied from the front-cover-sheet housing section 48*a* to produce booklets.

The book accumulation section 43 is composed of a chassis 43*a* and door 49, accumulates the booklets produced in the bookbinding section 41, and displaces the accumulated booklets to the moving wagon 46.

The chassis 43*a* is a chassis portion of the book accumulation section 43.

The door 49 is provided on the left-surface side of the chassis 43*a* so as to be operable and closable. The door 49 is configured to open when the moving wagon 46 is attached or detached, for example.

The moving wagon 46 is provided so as to be detachable and attachable from/to the chassis 43*a* of the book accumulation section 43. By displacing the bookbinded and accumulated booklets to the moving wagon 46, these booklets can be taken out from the second finishing apparatus 4 of type B to be transported.

The front-cover-sheet housing section 48*a* houses the front cover sheets of multiple types, and supplies a predetermined front cover sheet when the bookbinding section 41 perform bookbinding to produce the sheet bindles.

The wheel section 40*d* includes casters, in which wheels can whirl freely according to a moving direction.

The sheet-jam detection sensors 47 are provided at multiple portions along the sheet conveyance path, and when detecting the sheet jam, outputs sheet-jam information composed of an output signal thereof to the conveyance-unit-apparatus control section 600 through a serial communication section 401 to be hereinafter described.

The handle 40*e* is a pull handle, since the wheel section 40*d* whirls in pulling direction when pulling the handle 40*e* as detaching the first finishing apparatus of type B from the conveyance unit apparatus 6, the first finishing apparatus of type B can be transported easily.

The mounting pin 40*f* fits together with the pin join hole 83*a* of the conveyance unit apparatus 6, and enables attachment/detachment of the first finishing apparatus of type B and the conveyance unit apparatus 6. The mounting pin 40*f* includes a penetrating slot (not shown) through which the plunger of the solenoid 83*b* penetrates, the penetrating slot being formed from the upper side to the lower side of the mounting pin 40*f* while the mounting pin 40*f* fits together with the pin join hole 83*a*.

The connector 40*g* is a power source connector, and is connected to the connector 84 of the conveyance unit apparatus 6 to receive power supply from the conveyance unit apparatus 6. The first finishing apparatus of type B starts power supply from the conveyance unit apparatus 6 via the connector 40*g* according to an instruction (for example, printing instruction) from the conveyance-unit-apparatus control section 600. When power is supplied to each section of the first finishing apparatus of type B and preparation of finishing is completed, a signal indicating completion of preparation is transmitted to the conveyance-unit-apparatus control section 600.

Although two types are explained above, various known finishing apparatuses may be applied as the finishing apparatuses connected to the conveyance unit apparatus 6 as long as they can be connected to the finishing unit apparatus 6 and their type are classified according to finishing contents.

Next, placement examples of the finishing apparatuses with respect to the conveyance unit apparatus 6 will be described.

Figure 5A:
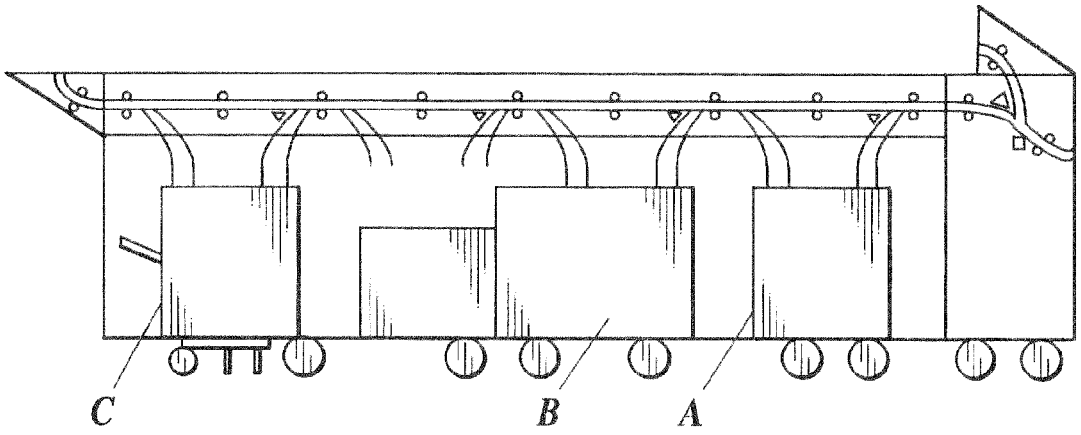
FIG. 5A is a diagram showing an example of placement of the finishing apparatus according to the embodiment to the conveyance unit apparatus.
Figure 5B:
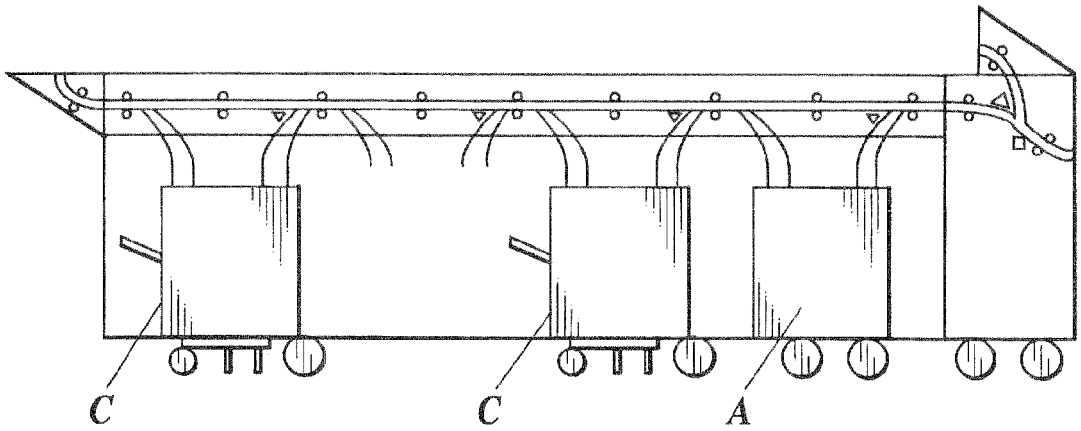
FIG. 5B is a diagram showing an example of placement of the finishing apparatus according to the embodiment to the conveyance unit apparatus.
Figure 5C:
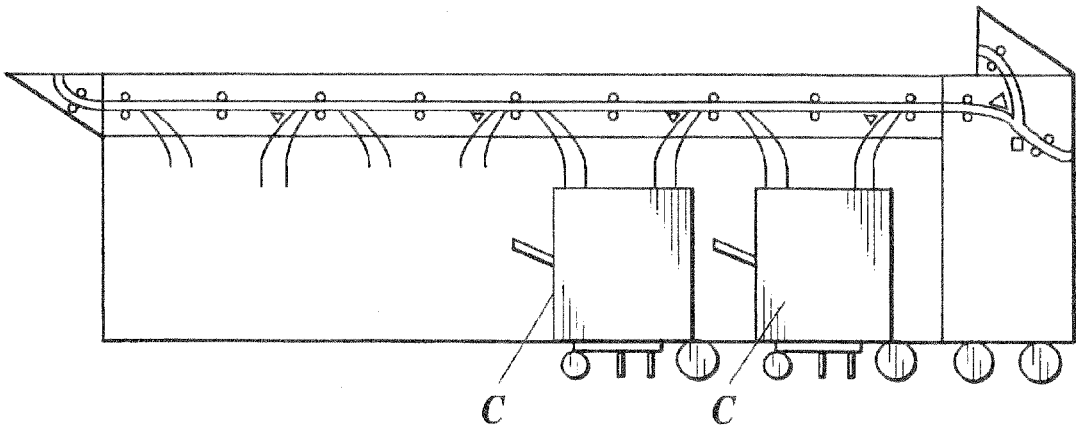
FIG. 5C is a diagram showing an example of placement of the finishing apparatus according to the embodiment to the conveyance unit apparatus.

FIGS. 5A-5C are front views showing placement examples of the finishing apparatuses with respect to the conveyance unit apparatus 6 according to the embodiment of the present invention. In the examples shown in FIGS. 5A-5C, the number of types of the finishing apparatuses is three (the finishing apparatus A of type A, the finishing apparatus B of type B, and the finishing apparatus C of type C).

The finishing apparatuses can be placed in the placement sections 80 respectively as shown in FIGS. 5A-5C as long as each of the finishing apparatuses includes the introducing port connectable to the discharging section 81 and the mounting pin which can fit together with the pin join hole 83*a* so that power is applied from the connector 84. For example, as shown in FIG. 5A, the finishing apparatuses may be placed discretely so that the placement section 80 in which the finishing apparatus is not placed exists between the placement sections 80 in each of which the finishing apparatus is placed.

As shown in FIG. 5B, the finishing apparatuses (for example, two finishing apparatuses C) may be provided in a plurality of placement sections 80 respectively.

As shown in FIG. 5C, two finishing apparatuses of one type (for example, type C) may be provided.

Figure 6A:
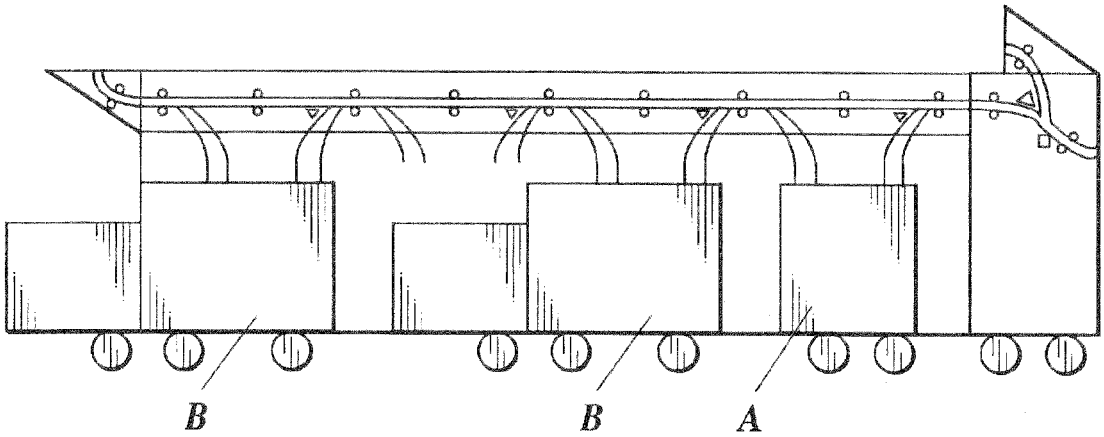
FIG. 6A is a diagram showing an example of placement of the finishing apparatus according to the embodiment to the conveyance unit apparatus.

As shown in FIG. 6A, a configuration where the finishing apparatus B is placed on the most-down-stream side of the conveyance unit apparatus 6 so that the finishing apparatus B protrudes outside of the conveyance unit apparatus 6 may be adopted. According to this configuration, for example, the finishing apparatus of larger size than other finishing apparatuses (for example, the finishing apparatus to perform staple processing or punching processing), for example the finishing apparatus to perform case binding, can be placed so as to be across two placement sections 80.

Figure 6B:
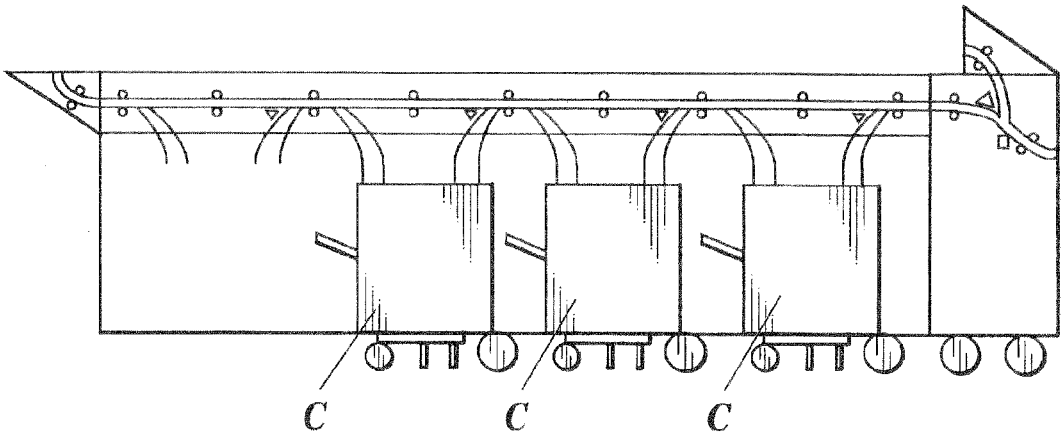
FIG. 6B is a diagram showing an example of placement of the finishing apparatus according to the embodiment to the conveyance unit apparatus.

As shown in FIG. 6B, a configuration where three finishing apparatus of one type are placed may also be adopted.

(Control Configuration of Image Forming System)

Next, a control configuration of the image forming system 1000 will be described with reference to FIG. 7.

Figure 7:
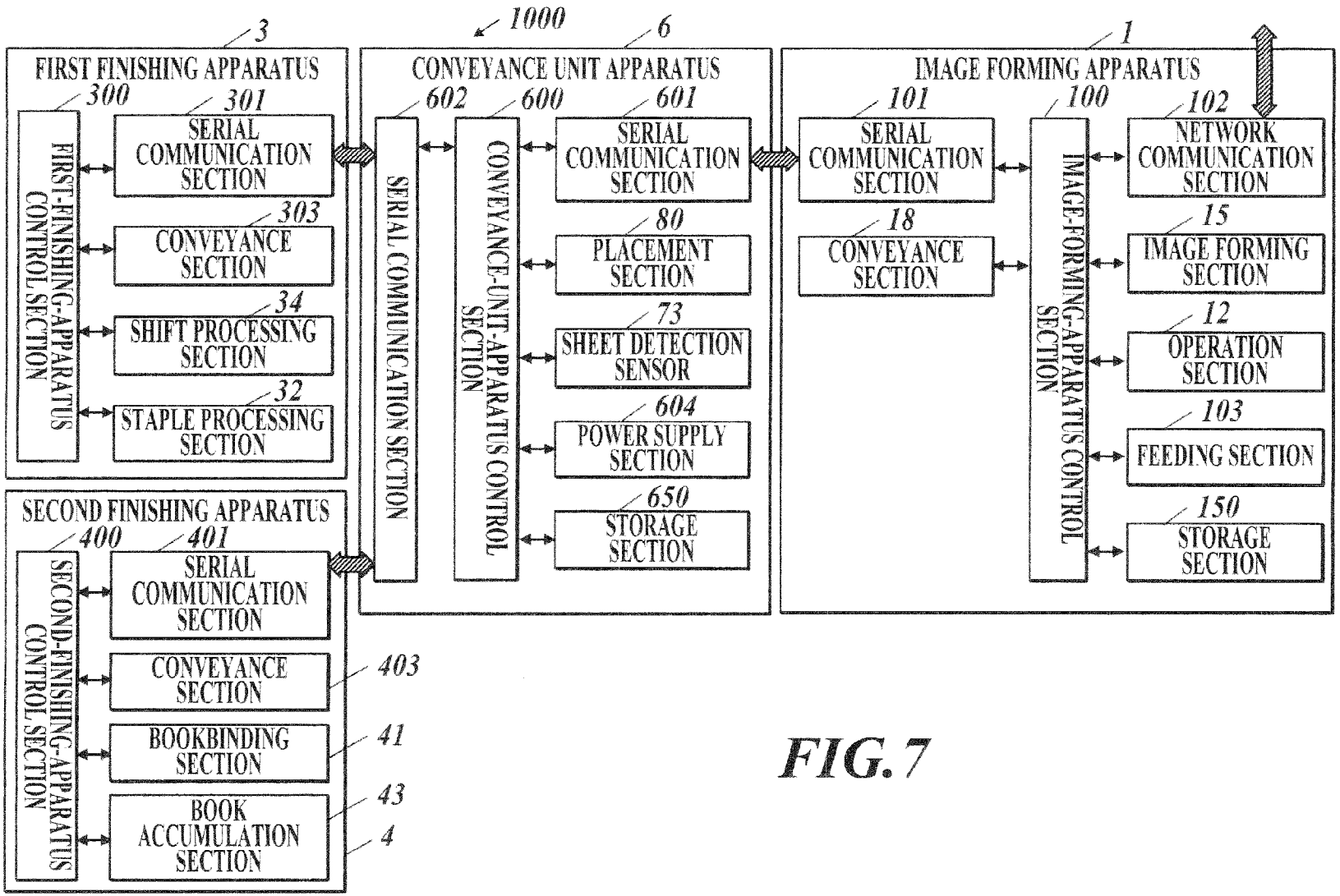
FIG. 7 is a block diagram of the image forming system according to the embodiment.

FIG. 7 is a block diagram of the image forming system 100 according to the embodiment of the present invention.

The image forming apparatus 1 is composed of the image-forming-apparatus control section 100, a serial communication section 101, a network communication section 102, a feeding section 103, a storage section 150, the operation section 12, the image forming section 15, the conveyance section 18, and so on. Since the operation section 12, the image forming section 15 and the conveyance section 18 are as mentioned above, explanations thereof are omitted here.

The image-forming-apparatus control section 100 is mainly composed of a CPU and a RAM, and controls processings with respect to the whole system such as image reading, image formation, wait processing to stop image formation during a predetermined time between image forming processings for the sheets to be printed successively to avoid continuous printing, and sheet conveying, and all controls of the image forming system.

The image-forming-apparatus control section 100 receives output settings such as various finishings set by a user via the operation section 12 as operation signals from the operation section 12. On the basis of the operation signals received by the image-forming-apparatus control section 100, sheet information (finishing information) which is composed of kind of necessary processing, sheet size for the processing, and so on, is created per each sheet on which the image is formed to be stored in the RAM.

When starting printing based on the job data input from not-shown personal computer or the like, the image-forming-apparatus control section 100 transmits a signal indicating that to the conveyance-unit-apparatus control section 600 6 through the serial communication section 101. When printing and output have been completed, similarly to the above, the image-forming-apparatus control section 100 transmits a signal indicating completion of printing and output to the conveyance-unit-apparatus control section 600 through the serial communication section 101.

Moreover, the image-forming-apparatus control section 100 judges which of the finishing apparatuses should be used for image formation, and transmits a judgment result to the conveyance unit, apparatus 6. In the embodiment, this judgment result is contained in a sheet ID given to each sheet. The sheet ID is used for identifying the image-formed sheet. The sheet ID includes information for identifying the finishing apparatus to perform finishing. For example, when the sheet ID is "1a", "1" of "1a" indicates that the sheet is the first sheet, and "a" of "1a" indicates that the finishing apparatus to be used is the first finishing apparatus 3 on the most upper stream. When the sheet ID is "1b", "1" of "1b" indicates that the sheet is the first sheet, and "b" of "1b" indicates that the finishing apparatus to be used is the second finishing apparatus 4 on the second upper stream. Thus, every time image formation is performed on the sheet corresponding to the given sheet ID, the image-forming-apparatus control section 100 transmits the sheet ID to the conveyance-unit-apparatus control section 600 through the serial communication section 101. The conveyance-unit-apparatus control section 600 6 judges which of the finishing apparatuses should be used based on the received sheet ID, and judges which of the gates should be opened/closed. The sheet ID is not limited to the above, and may be other data format as long as it includes information for identifying the number of sheets to be printed according to the job, and the finishing apparatus to be used for the sheets. For example, the sheet ID may include a character string like "page1-1, FNS3" (indicating the first page of the first set and the third finishing apparatus is used).

The serial communication section 101 transmits/receives information such as control information with serial communication to/from the conveyance unit apparatus 6. The serial communication section 101 transmits the sheet information stored in the RAM to the conveyance unit apparatus 6 for each sheet to be image-formed. The serial communication section 101 can obtain apparatus information of the first finishing apparatus 3 or the second finishing apparatus 4 transmitted from a serial communication section 601 of the conveyance unit apparatus 6.

The network communication section 102 transmits/receives the job data including the printing data, the sheet information, and the number of sets to be printed to/from external equipment such as a personal computer via a Local Area Network (LAN).

The feeding section 103 is composed of the abovementioned feeding tray 13*a*, feeding unit 5, and so on. The feeding section 103 feeds the sheets of various sizes (for example, A4, B5 and the like) to be image-formed from the feeding tray 13*a* or the feeding unit 5 as necessary. The feeding section 103 is provided with a size detection sensor (not shown) to detect sheet sizes and a presence/absence detection sensor (not shown) to detect presence/absence of each size of sheet. There sensors output the detected size and presence/absence of the sheet to the image-forming-apparatus control section 100.

The storage section 150 stores, in addition to various control programs to be executed by the image-forming-apparatus control section 100, the received job data, various pieces of setting information, parameters necessary for performing processings with the program, data of processing results, and so on.

The conveyance unit apparatus 6 includes the conveyance-unit-apparatus control section 600, the serial communication section 601, a serial communication section 602, a power supply section 604, a storage section 650, one or more of the placement sections 80, the sheet detection sensor 73, and so on. Since the placement sections 80 and the sheet detection sensor 73 are as above-mentioned, explanations thereof are omitted here.

The conveyance-unit-apparatus control section 600 is mainly composed of a CPU and a RAM, and performs all controls such as various processings in the conveyance unit apparatus 6.

The RAM obtains the sheet information transmitted from the image forming apparatus 1 and the apparatus information transmitted from each of the finishing apparatuses to temporarily store these pieces of information. The apparatus information is information for identifying each of the finishing apparatuses respectively connected to the conveyance unit apparatus 6, and includes pieces of information such as a type and processing speed of each of the finishing apparatuses. The apparatus information is obtained from each of the finishing apparatuses according to the instruction of the conveyance-unit-apparatus control section 600 when the finishing apparatuses each including the introducing port connectable to the discharging section 81 and the mounting pin which can fit together with the pin joint hole 83*a* and each being supplied with a power source from the connector 84 are connected to the conveyance unit apparatus 6 respectively. The apparatus information is stored in not-shown memories or the like of the finishing apparatuses.

The conveyance-unit-apparatus control section 600 receives completion of sheet discharge from the image forming apparatus 1 through the serial communication section 601. In the image forming apparatus 1, when the discharging section 18 discharges the sheets, the sensor of the discharging section 18 transmits the signal indicating completion of sheet discharge to the conveyance-unit-apparatus control section 600. The conveyance-unit-apparatus control section 600 detects the completion of sheet discharge by receiving this signal.

The conveyance-unit-apparatus control section 600 also controls switching of the discharging-section switching plates 67 based on the sheet information received from the image forming apparatus 1. The signals indicating completion of sheet discharge are received from the first finishing apparatus 3 and the second finishing apparatus 4 through the serial communication section 602.

The serial communication sections 601, 602 transmit/receive various pieces of information such as control information and apparatus information with serial communication to/from the image forming apparatus 1, the first finishing apparatus 2, and the second finishing apparatus 4.

The sheet information such as the sheet ID transmitted from the image forming apparatus 1 is obtained via the serial communication section 601, and the apparatus information of the first finishing apparatus 3 or the second finishing apparatus 4 is transmitted to the image forming apparatus 1. The conveyance-unit-apparatus control section 600 obtains the apparatus information from the first finishing apparatus 3 or the second finishing apparatus 4 through the serial communication section 602.

The power supply section 604 supplies power to each of the finishing apparatuses respectively placed in the placement sections 80 when executing a power control program 650*b* to be hereinafter described.

The storage section 650 stores, in addition to various control programs to be executed by the conveyance-unit-apparatus control section 600, various pieces of setting information, parameters necessary for performing processing with the programs, data of processing results, and so on.

The conveyance-unit-apparatus control section 600 performs a control to switch the conveyance-path switching plate 71 and the discharging-section switching plates 67 based on the sheet information stored in the conveyance-unit-apparatus control section 600 by the program stored in the storage section 650.

Specifically, when executing this program, the conveyance-unit-apparatus control section 600 judges to which of finishing apparatuses respectively placed in the placement sections 80 the sheets are discharged based on the sheet ID included in the sheet information. The discharging-section switching plates 67 are switched so that the sheets are discharged to the discharging section 81 corresponding to the judged finishing apparatus. Incidentally, a method for switching the discharging-section switching plates 67 is not limited to the above as long as switching is performed based on the information for indicating the finishing apparatus to be used transmitted from the image forming apparatus 1. For example, the information for identifying the finishing apparatus to be used may be transmitted separately from the sheet information.

In addition, the conveyance-unit-apparatus control section 600 may switch the conveyance-path switching plate 71 so that the sheets are delivered to the upper-stream-side delivery section 70 when the sheet information does not include information regarding finishing of the sheets.

When the conveyance-unit-apparatus control section 600 judges that notification of print start has been received from the image forming apparatus 1 by controlling by the program stored in the storage section 650, the conveyance-unit-apparatus control section 600 judges which of the finishing apparatuses is used in the job based on the sheet ID or the like transmitted from the image forming apparatus, supplies power the finishing apparatus which is to receive the sheets, via the power supply section 604, and controls the power supply section 604 not to supply power to the finishing apparatus other than the above finishing apparatus.

The conveyance-unit-apparatus control section 600 also performs control to restrict detachment of the finishing apparatus to which power is supplied among the finishing apparatuses respectively placed in the placement sections 80 by controlling by the program stored in the storage section 650.

Specifically, the control section 600 drives the solenoid 83*b* of the attaching/detaching section 83 so that the finishing apparatus to which power is supplied through the power supply section 604 is prevented from being detached from each of the placement sections 80.

The first finishing apparatus 3 is configured to include a first-finishing-apparatus control section 300, the serial communication section 301, a conveyance section 303, the staple processing section 32, and the shift processing section 34.

Since the staple processing section 32 and the shift processing section 34 are as abovementioned, explanations thereof are omitted here.

The first-finishing-apparatus control section 300 is mainly composed of a CPU and a RAM, and controls finishings (staple processing, shift processing and the like) in the staple processing section 32 and the shift processing section 34, and so on.

The serial communication section 301 transmits/receives information such as control information to/from the conveyance unit apparatus 6 with serial communication.

The serial communication section 301 transmits sheet-jam information output from the sheet-jam detection sensor 37 to the conveyance unit apparatus 6, and transmits the apparatus information including information for identifying the type of each of the finishing apparatuses responding to a transmission request from the conveyance unit apparatus 6.

The serial communication section 301 also transmits a preparation completion notification indicating that the first finishing apparatus 3 is in an operatable state to the conveyance unit apparatus 6.

The conveyance section 303 controls the sheet conveyance path for the sheet received by the introducing port 30*a*.

Specifically, the conveyance section 303 controls switching between the path for conveying the sheets to the sheet discharge tray 31 and the path for returning the sheets conveyed to the introducing port 30*b* to the conveyance path 64 of the conveyance unit apparatus 6, with the conveyance-path switching plate 30*c*, for example.

The second finishing apparatus 4 is configured to include a second-finishing-apparatus control section 400, the serial communication section 401, a conveyance section 403, a storage section 450, the bookbinding section 41*n*, the book accumulation section 43, and so on.

Since the bookbinding section 41 and the book accumulation section 43 are as abovementioned, explanation thereof are omitted here.

The second-finishing-apparatus control section 400 is mainly composed of a CPU and a RAM, and controls finishings such as case binding in the second finishing apparatus and the like.

The serial communication section 401 functions to transmit/receive information such as control information to/from the conveyance unit apparatus 6 with serial communication.

The serial communication section 401 transmits sheet-jam information output from the sheet-jam detection sensor 47 to the conveyance unit apparatus 6, and transmits apparatus information including information for identifying the type of each of the finishing apparatuses responding to the transmission request from the conveyance unit apparatus 6.

The serial communication section 401 also transmits a preparation completion notification indicating that the second finishing apparatus 4 is in an operable state to the conveyance unit apparatus 6.

The conveyance section 403 controls conveyance paths (for example, the path for conveying the sheets to the sheet discharge tray 41) for the sheets received by the introducing port 40*a*.

Next, operations will be described.

FIG. 8 shows a flowchart of processing to be performed in the image forming apparatus 1 when the power source is turned on. The processing shown in FIG. 8 is executed by cooperation between the image-forming-apparatus control section 100 and the programs stored in the storage section 150.

As shown in FIG. 8, the image-forming-apparatus control section 100 firstly requests the conveyance unit apparatus 6 to send the apparatus information regarding each of the finishing apparatuses respectively placed in the placement sections 80 (Step S101). Next, the image-forming-apparatus control section 100 judges whether or not a notification of the apparatus information has been received from the conveyance unit apparatus 6 (Step S102).

When the image-forming-apparatus control section 100 does not judge that the apparatus information has been received (Step S102: NO), the processing returns to Step S102, and it is judged whether or not the notification of the apparatus information has been received from the conveyance unit apparatus 6.

When the image-forming-apparatus control section 100 judges that the apparatus information has been received (Step S102: YES), the image-forming-apparatus control section 100 makes the LCD of the operation section 12 display the connection state of each of the finishing apparatuses respectively connected to the conveyance unit apparatus 6 based on the apparatus information (Step S103). A display screen of Step S103 includes, though being not especially limited, information such as the type of each of the finishing apparatuses respectively connected to the conveyance unit apparatus 6.

The image-forming-apparatus control section 100 secondly judges whether or not the printing instruction has been input from the operation section or the like (Step S104). The printing instruction is input by depressing a start button of the operation section 12 or receiving the job data from a now-shown external apparatus via the network. When the printing instruction is input, the image-forming-apparatus control section 100 transmits information indicating that to the conveyance unit apparatus 6.

When the control section does not judge that the printing instruction has been input (Step S104: NO), the processing returns to Step S104, and it is judged whether or not the printing instruction has been input from the operation section 12 or the like.

When the control section judges that the printing instruction has been input (Step S104: YES), the image-forming-apparatus control section 100 judges whether or not a speed of continuous printing of the image forming apparatus 1 is equal to a speed of continuous processing of the finishing apparatuses connected to the conveyance unit apparatus 6 or less (Step S105). The information regarding the speed of continuous processing of each of the finishing apparatuses respectively connected to the conveyance unit apparatus 6 is contained in the apparatus information received in Step S102, and stored in the storage section 150 or the like.

When the image-forming-apparatus control section 100 does not judge that the speed of continuous printing is equal to the speed of continuous processing or less (Step S105: NO), the image-forming-apparatus control section 100 judges whether or not there is the plurality of (N of) finishing apparatuses of the same type among the finishing apparatuses respectively connected to the conveyance unit apparatus 6 on the basis of the received pieces of apparatus information of the finishing apparatuses (Step S106). For example, in the case of a connection example shown in FIG. 5A, since there are one finishing apparatus of type A, one finishing apparatus of type B, and one finishing apparatus of type C, which are connected to the conveyance unit apparatus 6, the image-forming-apparatus control section 100 does not judge that there are the plurality of finishing apparatus of the same type in Step S106. In the case of a connection example shown in FIG. 5B, since there are one finishing apparatus of type A and two finishing apparatuses of type C, which are connected to the conveyance unit apparatus 6, the image-forming-apparatus control section 100 judges that there are the plurality of finishing apparatus of the same type, namely two finishing apparatuses of type C, in Step S106.

When the image-forming-apparatus control section 100 judges that there are a plurality of finishing apparatuses of the same type (Step S106: YES), the image-forming-apparatus control section 100 judges whether or not the remaining number of the number X of sets to be processed is equal to N or more (Step S107). The number X of sets is contained in the job data, and stored in the storage section 150.

When the image-forming-apparatus control section 100 judges the remaining number is equal to N or more (Step S107: YES), the image-forming-apparatus control section 100 determines page distributing processing (Step S108). Specifically, the image-forming-apparatus control section 100 determines the finishing apparatus to which the sheets discharged from the image forming apparatus 1 to the conveyance unit apparatus 6 should be distributed based on the number of sets and finishing content contained in the job data, the speed of continuous printing of the image forming apparatus, and the received apparatus information. For example, when the speed of continuous printing of the image forming apparatus 1 is 120 ppm and there are two finishing apparatuses of the same type each having the processing speed of 60 ppm, and when five documents are printed/processed, the page distributing processing becomes as follows depending on the number of sets.

When the number of sets is one (1), the image forming apparatus 1 performs image formation of the first sheet, and then performs wait processing during the time necessary for one sheet, namely for 0.5 seconds. After performing image formation of the second sheet, wait processing is performed during the time necessary for one sheet, namely for 0.5 seconds. After performing image formation of the third sheet, wait processing is performed during the time necessary for one sheet, namely for 0.5 seconds. After performing image formation of the fourth sheet, wait processing is performed during the time necessary for one sheet, namely for 0.5 seconds. After performing image formation of the fifth sheet, the printing processing ends.

In this case, a sheet discharging destination is determined to be only one finishing apparatus among two finishing apparatuses in Step S108.

When the number of sets is two, the image forming apparatus 1 performs image formation of the first sheet of the first set, and then performs image formation of the first sheet of the second set. After performing image formation of the second sheet of the first set, image formation of the second sheet of the second set is performed. After performing image formation of the third sheet of the first set, image formation of the third sheet of the second set is performed. After performing image formation of the fourth sheet of the first set, image formation of the fourth sheet of the second set is performed. When image formation of the fifth sheet of the first set is performed and then image formation of the fifth sheet of the second set has been performed, the printing processing ends.

In this case, the sheet discharging destination is determined to be both of two finishing apparatuses in Step S108, and the sheet discharging destination of the sheets of the first set and the sheet discharging destination of the sheets of the second set are distributed to the determined finishing apparatuses respectively.

When the number of sets is three, the image forming apparatus 1 performs image formation of the first sheet of the first set, and then performs image formation of the first sheet of the second set. After performing image formation of the second sheet of the first set, image formation of the second sheet of the second set is performed. After performing image formation of the third sheet of the first set, image formation of the third sheet of the second set is performed. After performing image formation of the fourth sheet of the first set, image formation of the fourth sheet of the second set is performed. After performing image formation of the fifth sheet of the first set, image formation of the fifth sheet of the second set is performed. After performing image formation of the first sheet of the third set, wait processing is performed during the time necessary for one sheet, namely for 0.5 seconds. After performing image formation of the second sheet of the third set, wait processing is performed during the time necessary for one sheet, namely for 0.5 seconds. After performing image formation of the third sheet of the third set, wait processing is performed during the time necessary for one sheet, namely for 0.5 seconds. After performing image formation of the fourth sheet of the third set, wait processing is performed during the time necessary for one sheet, namely for 0.5 seconds. When image formation of the fifth sheet of the third set has been performed, the printing processing ends.

In this case, the sheet discharging destination is determined to be both of two finishing apparatuses in Step S108, the sheet discharging destination of the sheets of the first set and the sheet discharging destination of the sheets of the second set are distributed to the determined finishing apparatuses respectively, and the sheet discharging destination of the sheets of the third set is determined to be one of the two finishing apparatuses.

When the number of sets is four, the image forming apparatus 1 performs image formation of the first sheet of the first set, and then performs image formation of the first sheet of the second set. After performing image formation of the second sheet of the first set, image formation of the second sheet of the second set is performed. After performing image formation of the third sheet of the first set, image formation of the third sheet of the second set is performed. After performing image formation of the fourth sheet of the first set, image formation of the fourth sheet of the second set is performed. After performing image formation of the fifth sheet of the first set, image formation of the fifth sheet of the second set is performed. After performing image formation of the first sheet of the third set, image formation of the first sheet of the fourth set is performed. After performing image formation of the second sheet of the third set, image formation of the second sheet of the fourth set is performed. After performing image formation of the third sheet of the third set, image formation of the third sheet of the fourth set is performed. After performing image formation of the fourth sheet of the third set, image formation of the fourth sheet of the fourth set is performed. When image formation of the fifth sheet of the third set is performed and then image formation of the fifth sheet of the fourth set is performed, the printing processing ends.

In this case, the sheet discharging destination is determined to be both of two finishing apparatuses in Step S108, and the sheet discharging destination of the sheets of the first set and the sheet discharging destination of the sheets of the second set are distributed to the determined finishing apparatuses respectively. Similarly, the sheet discharging destination of the sheets of the third set and the sheet discharging destination of the sheets of the fourth set are distributed to the selected finishing apparatuses respectively. The determining processing in Step S108 is not, limited to the above as long as finishings are distributed to the finishing apparatuses of the same type uniformly according to the previously-determined method. For example, such distribution is performed in view of the processing speed of the finishing apparatuses.

Returning to FIG. 8, the image-forming-apparatus control section 100 performs the distributing processing sequence determined in Step S108 (Step S109). In Step S109, the distributing processing determined in Step S108 is transmitted to the conveyance-unit-apparatus control section 600.

The image-forming-apparatus control section 100 subtracts N from the number X of sets stored in the RAM (Step S110). Then, the image-forming-apparatus control section 100 refers to the number X of sets to determine whether or not the print output has been completed (Step S114). When the number X of sets is zero or less, it is judged that the print output has been completed.

When the image-forming-apparatus control section 100 does not judge that the print output has been completed (Step S114: NO), the processing returns to Step S105, and the image-forming-apparatus control section 100 judges whether or not the speed of continuous printing of the image forming apparatus 1 is lower than the speed of the continuous processing of the finishing apparatuses.

On the other hand, when the image-forming-apparatus control section 100 judges that the speed of continuous printing is equal to the speed of continuous processing or less (Step S105: YES), the image-forming-apparatus control section 100 performs a normal printing sequence without the wait processing or the distributing processing (Step S111). Specifically, in Step S111, the image forming apparatus 1 continuously performs image formation without performing the abovementioned wait processing, and discharges the sheets to the single finishing apparatus whose type of finishing agrees with the finishing content contained in the sheet information through the conveyance unit apparatus 6.

On the other hand, when the image-forming-apparatus control section 100 does not judge that there are a plurality of finishing apparatuses of the same type (Step S106: NO), and/or when the image-forming-apparatus control section 100 does not judge the remaining number is equal to N or more (Step S107: NO), the image-forming-apparatus control section 100 performs a printing sequence with between-sheets wait processing without performing distributing processing (Step S112). Concretely, the image forming apparatus 1 performs image formation onto the sheet while performing the abovementioned wait processing, and discharges the sheets to the single finishing apparatus via the conveyance unit apparatus 6. When the processing speed of the finishing apparatus is low, the image forming apparatus can perform the wait processing so as to space between image forming processings to the sheets depending on the processing speed of the finishing apparatus.

Next, the image-forming-apparatus control section 100 1 subtracts one (1) from the number X of sets (Step S113).

On the other hand, when the image-forming-apparatus control section 100 judges that the print output has been completed (Step S114: YES), the image-forming-apparatus control section 100 ends the processing.

Figure 9:
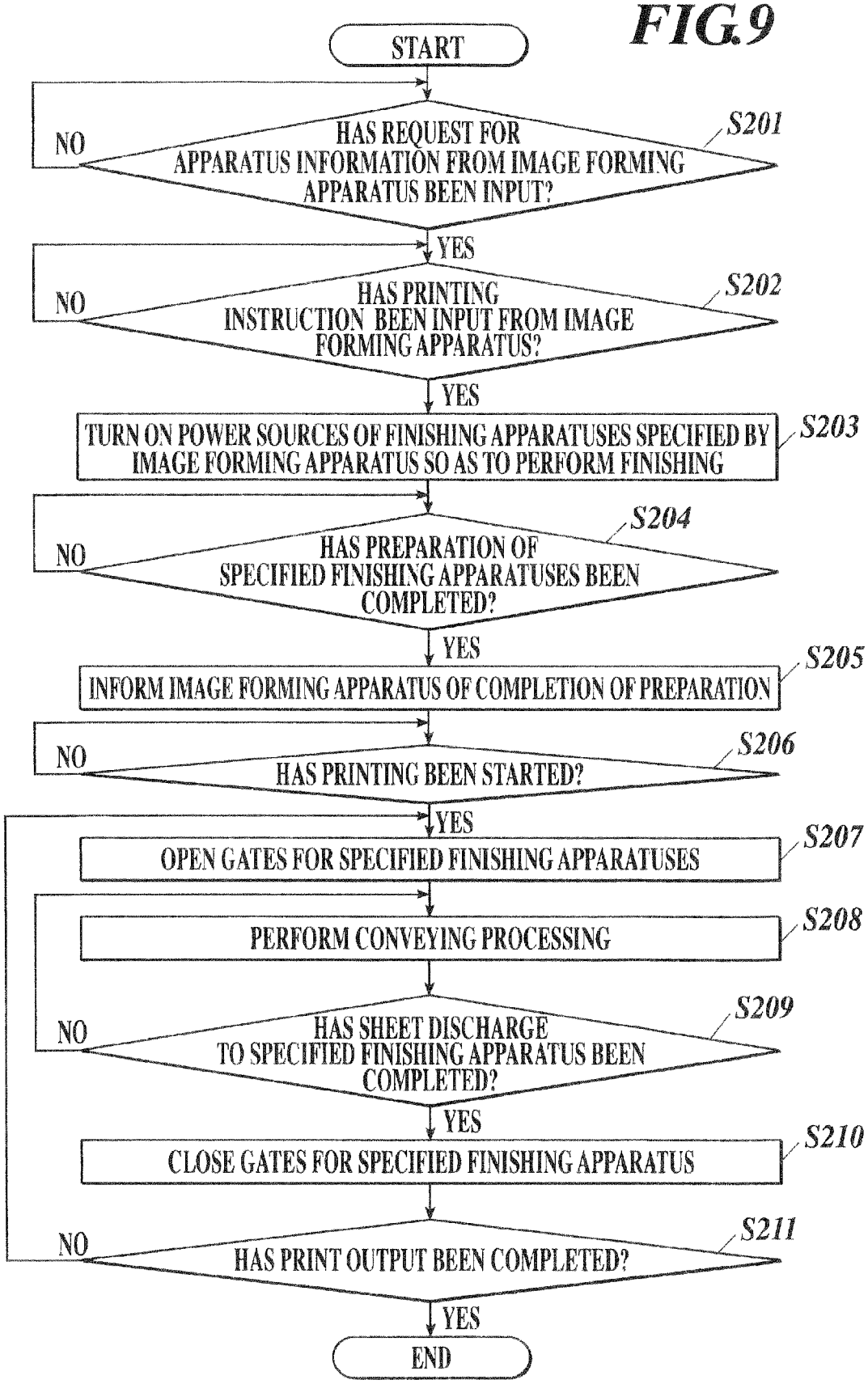
FIG. 9 is a flowchart showing processing by the conveyance unit apparatus according to the embodiment.

FIG. 9 shows a flowchart of processing to be performed in the conveyance unit apparatus 6 when the power source is turned on. The processing shown in FIG. 9 is executed by cooperation between the conveyance-unit-apparatus control section 600 and the programs stored in the storage section 650.

As shown in FIG. 9, the conveyance-unit-apparatus control section 600 firstly judges whether or not a request for the apparatus information from the image forming apparatus has been input (Step S201). When the control section does not judge that the request has been input (Step S201: NO), the processing returns to Step S201, and it is judged whether or not the request for the apparatus information has been input from the image forming apparatus.

When the control section 600 judges that the request has been input (Step S201: YES), the conveyance-unit-apparatus control section 600 judges whether or not the printing instruction has been input from the image forming apparatus 1 (Step S202). When the control section 600 does not judge that the printing instruction has been input (Step S202: NO), the processing returns to Step S202, and it is judged whether or not the printing instruction has been input from the image forming apparatus 1.

When the control section 600 judges that the printing instruction has been input (Step S202: YES), the conveyance-unit-apparatus control section 600 turns on power sources of the finishing apparatuses specified by the image forming apparatus 1 so as to perform finishings (Step S203). In Step S203, it is instructed to turn on the power sources, and at the same time, the finishing apparatuses are required to send the pieces of apparatus information. Then, the conveyance-unit-apparatus control section 600 judges whether or not these specified finishing apparatuses have been activated and preparation has been completed (Step S204).

When the control section 600 does not judge that the preparation has been completed (Step S204: NO), the processing returns to Step S204, and it is judged whether or not these specified finishing apparatuses have been activated and preparation has been completed.

When the control section 600 judges that the preparation has been completed (Step S204: YES), the conveyance-unit-apparatus control section 600 informs the image forming apparatus 1 of the completion of preparation (Step S205). In Step S205, the apparatus information is transmitted to the image forming apparatus 1 concurrently with the completion of preparation.

Next, the conveyance-unit-apparatus control section 600 judges whether or not printing in the image forming apparatus 1 has been started (Step S206). When the printing is started, a predetermined signal has been transmitted from the image-forming-apparatus control section 100 to the conveyance-unit-apparatus control section 600.

When the control section 600 does not judge that the printing has been started (Step S206: NO), the processing returns to Step S206, and it is judged whether or not the printing in the image forming apparatus 1 has been started.

When the control section 600 judges that the printing has been started (Step S206: YES), the conveyance-unit-apparatus control section 600 opens the gates 81*a* corresponding to the finishing apparatuses specified by the image forming apparatus 1 (Step S207). The gates 81*a* which should be opened in Step S207 are gates of the finishing apparatuses corresponding to the distributing method determined by the image forming apparatus 1 in Step S108.

Then, the conveyance-unit-apparatus control section 600 switches the discharging-section switching plates 67 so that the sheets are conveyed to the finishing apparatuses for which the gates 81*s* have been opened, and performs the conveying processing (Step S208). The conveyance-unit-apparatus control section 600 judges whether or not sheet discharge to the specified finishing apparatuses has been completed (Step S209).

When the control section 600 does not judge that the sheet discharge has been completed (Step S209: NO), the processing returns to Step S208.

When the control section 600 judges that the sheet discharge has been completed (Step S209: YES), the conveyance-unit-apparatus control section 600 closes the gates 81*a* corresponding to the finishing apparatuses specified by the printing instruction from the image forming apparatus 1 (Step S210.)

The conveyance-unit-apparatus control section 600 judges whether or not print output has been completed (Step S211). When the control section 600 does not judge that the print output has been completed (Step S211: NO), the processing returns to Step S207, and the conveyance-unit-apparatus control section 600 opens the gates 81*a* corresponding to the finishing apparatuses specified by the printing instruction from the image forming apparatus 1.

When the control section 600 judges that the print output has been completed (Step S211: YES), the processing ends.

Figure 10:
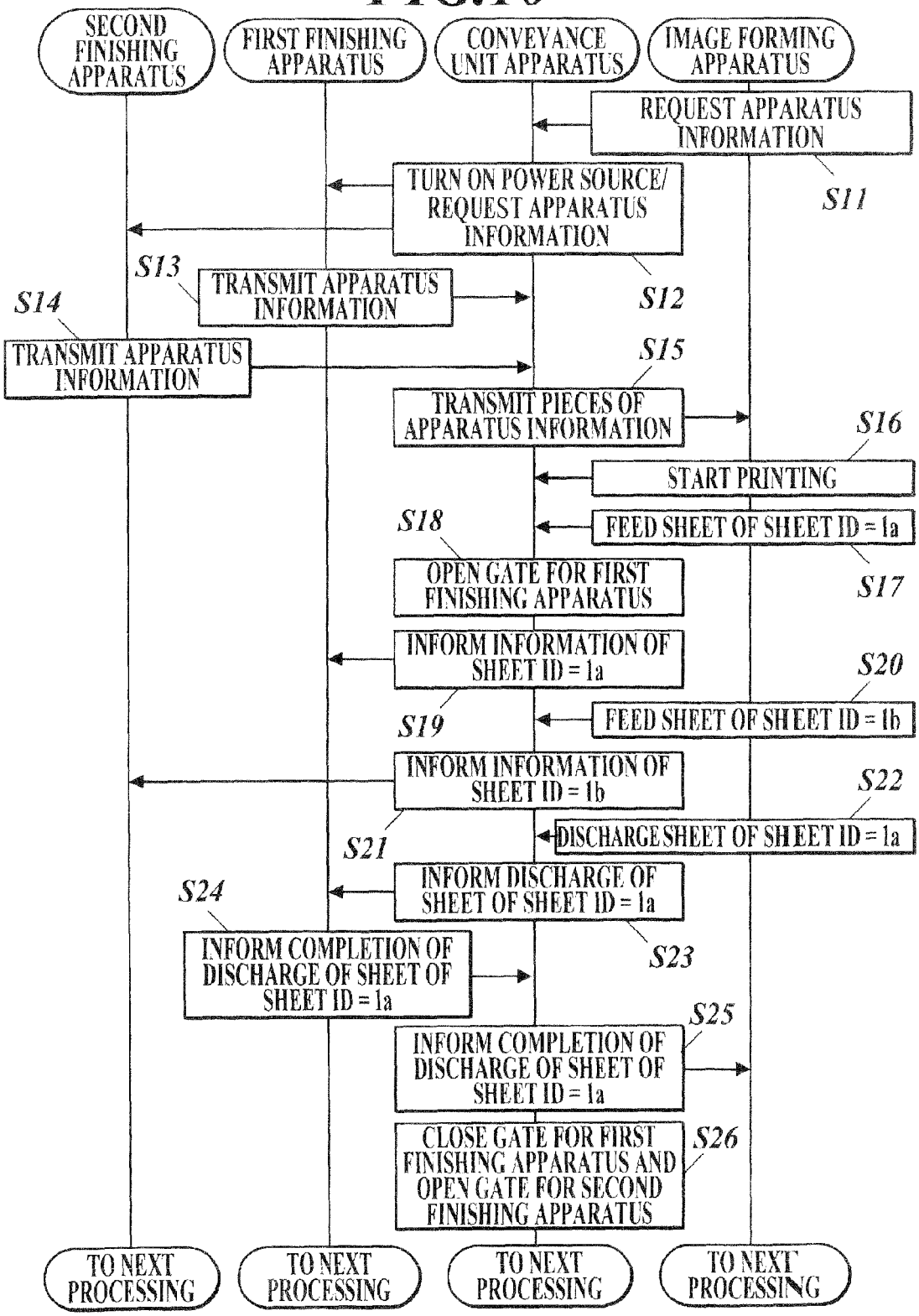
FIG. 10 is a flowchart showing sheet discharging processing by the image forming system according to the embodiment.

Next, a flow of processing of the whole image forming system 1000 when the processings shown in FIGS. 8 and 9 are performed will be described. FIG. 10 shows the flow of processing in the image forming system 100. In an example explained below, it is assumed that the finishing apparatuses placed in the placement sections 80 are two finishing apparatuses (first finishing apparatus 3 and the second finishing apparatus 4) of the same type, the number of sets according to the job to be executed is two, and the number of sheets to be output is two. It is also assumed that the processing speeds of the first finishing apparatus and the second finishing apparatus are the same value of 60 ppm, and the speed of continuous printing of the image forming apparatus 1 is 120 ppm. In this case, the image-forming-apparatus control section 100 judges that in Step S108, image formation of the first sheet of the first set is performed and then image formation of the first sheet of the second set is performed, and image formation of the second sheet of the first set is performed and then image formation of the second sheet of the second set is performed. The image-forming-apparatus control section 100 also judges that finishing for the sheets of the first set is performed by the first finishing apparatus, and finishing for the sheets of the second set is performed by the second finishing apparatus. Moreover, the image-forming-apparatus control section 100 gives the sheet ID "1a" to the first sheet of the first set, and gives the sheet. ID "1b" to the first sheet of the second set. Similarly, the image-forming-apparatus control section 100 gives the sheet ID "2a" to the second sheet of the first set, and gives the sheet ID "2b" to the second sheet of the second set.

As shown in FIG. 10, the image-forming-apparatus control section 100 firstly requests the conveyance unit apparatus 6 to send the apparatus information regarding each of the finishing apparatuses respectively placed in the placement sections 80, similarly to Step S101 (Step S11).

The conveyance-unit-apparatus control section 600 confirms the connection states of the finishing apparatus respectively placed in the placement sections 80 by using the connection detection sensors 85, turns on the power source of each of the finishing apparatuses by the power supply section 604, and requests for the apparatus information regarding each of the finishing apparatuses via the serial communication section 602, similarly to Step S203 (Step S12).

The first-finishing-apparatus control section 300 and the second-finishing-apparatus control section 400 transmit the pieces of apparatus information to the conveyance unit apparatus 6 through the serial communication section 301 and the serial communication section 401 respectively (Step S13, Step S14).

The conveyance-unit-apparatus control section 600 transmits the pieces of apparatus information obtained in Step S13 and Step S14 to the image forming apparatus 1, similarly Step S205 (Step S15).

The image-forming-apparatus control section 100 transmits the signal indicating that printing has been started to the conveyance unit apparatus 6 (Step S16). Then, the image-forming-apparatus control section 100 makes the feeding tray 13*a* or the feeding unit 5 feed the sheet corresponding to the sheet ID "1a" to start image formation, and transmits the signal indicting that the sheet whose sheet ID is "1a" has been fed, to the conveyance unit apparatus 6 (Step S17).

The conveyance-unit-apparatus control section 600 judges which of the gates 81*a* should be opened based on the received sheet ID, opens the gate 81*a* corresponding to the first finishing apparatus indicated by the sheet ID "1a", and switches the discharging-section switching plates 67, similarly to Step S207 (Step S18). Then, the conveyance-unit-apparatus control section 600 transmits information of the sheet ID "1a" to the first finishing apparatus 3 (Step S19).

The image-forming-apparatus control section 100 makes the feeding tray 13*a* or the feeding unit 5 feed the sheet corresponding to the sheet ID "1b" to start image formation, and transmits the signal indicating the sheet whose sheet ID is "1b" has been fed, to the conveyance unit apparatus (Step S20). Then, the conveyance-unit-apparatus control section 600 transmits information of the sheet ID "1b" to the second finishing apparatus 4 (Step S21).

The image-forming-apparatus control section 100 transmits the signal indicating that the sheet whose sheet ID is "1a" has been discharged to the conveyance apparatus 6, with respect to the conveyance apparatus 6 (Step S22). The conveyance-unit-apparatus control section 600 transmits the signal indicating the discharge of the sheet whose sheet ID is "1a" to the first finishing apparatus 3 (Step S23).

The first-finishing-apparatus control section 300 informs the conveyance unit apparatus 6 of completion of discharge of the sheet whose sheet ID is "1a" by using the sensor provided in the introducing port 30*a* (Step S24). The conveyance-unit-apparatus control section 600 informs the image forming apparatus 1 of completion of discharge of the sheet whose sheet ID is "1b" (Step S25). Next, the conveyance-unit-apparatus control section 600 judges which of the gates 81*a* should be opened based on the sheet ID of the sheet to be discharged after discharge of the sheet whose sheet ID is "1a" (namely, based on the sheet ID "1b"), closes the gate 81*a* corresponding to the first finishing apparatus 3, opens the gate 81*a* corresponding to the second finishing apparatus 4, and switches the discharging-section switching plates 67 (Step S26).

Figure 11:
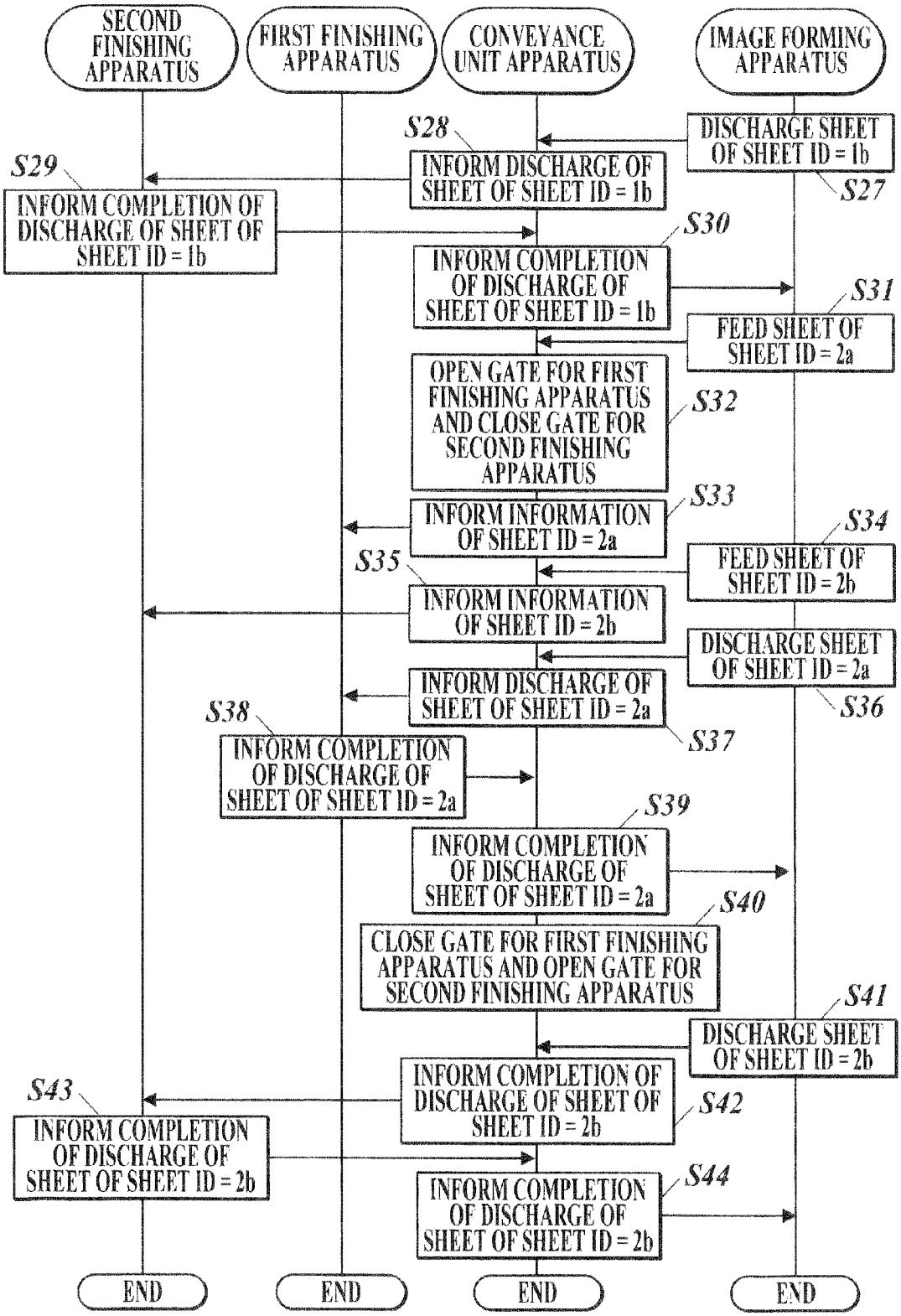
FIG. 11 is a flowchart showing sheet discharging processing by the image forming system according to the embodiment.

Then the processing shifts to processing shown in FIG. 11, and the image-forming-apparatus control section 100 transmits the signal indicating that the sheet whose sheet ID is "1b" has been discharged to the conveyance unit apparatus 6, with respect to the conveyance unit apparatus (Step S27). The conveyance-unit-apparatus control section 600 transmits the signal indicating the discharge of the sheet whose sheet ID is "1b" to the second finishing apparatus 4 (Step S28).

The second-finishing-apparatus control section 400 informs the conveyance unit apparatus 6 of the completion of discharge of the sheet whose sheet ID is "1b" (Step S29). The conveyance-unit-apparatus control section 600 informs the image forming apparatus 1 of the completion of discharge of the sheet whose sheet ID is "1b" (Step S30).

Then, the image-forming-apparatus control section 100 makes the feeding tray 13*a* or the feeding unit 5 feed the sheet to which the sheet ID has been given to start image formation, and transmits the signal indicating that the sheet whose sheet ID is "2a" has been fed to the conveyance unit apparatus 6 (Step S31).

The conveyance-unit-apparatus control section 600 judges which of the gates 81*a* should be opened on the basis of the received sheet ID, opens the gate 81*a* corresponding to the first finishing apparatus 3 which the sheet ID "2a" indicates, closes the gate 81*a* corresponding to the second finishing apparatus 4, and switches the discharging-section switching plates 67 (Step S32). Then, the conveyance-unit-apparatus control section 600 transmits information of the sheet ID "2a" to the first finishing apparatus 3.

The image-forming-apparatus control section 100 makes the feeding tray 13*a* or the feeding unit 5 feed the sheet corresponding to the sheet ID "2b" to start image formation, and transmits the signal indicating that the sheet whose sheet ID is "2b" has been fed to the conveyance unit apparatus 6 (Step S34). Then, the conveyance-unit-apparatus control section 600 transmits information of the sheet ID "2b" to the second finishing apparatus 4 (Step S35).

The image-forming-apparatus control section 100 transmits the signal indicating that the sheet whose sheet ID is "2a" has been discharged to the conveyance unit apparatus 6, with respect to the conveyance unit apparatus (Step S36). The conveyance-unit-apparatus control section 600 transmits the signal indicating the discharge of the sheet whose sheet ID is "2a" to the first finishing apparatus 3 (Step S7).

The first-finishing-apparatus control section 300 informs the conveyance unit apparatus 6 of completion of discharge of the sheet whose sheet ID is "2a" (Step S38). The conveyance-unit-apparatus control section 600 informs the image forming apparatus 1 of completion of discharge of the sheet whose sheet ID is "2a" (Step S39) Next, the conveyance-unit-apparatus control section 600 judges which of the gates 81*a* should be opened based on the sheet ID of the sheet to be discharged after discharge of the sheet whose sheet ID is "2a", closes the gate 81*a* corresponding to the first finishing apparatus 3, opens the gate 81*a* corresponding to the second finishing apparatus 4, and switches the discharging-section switching plates 67 (Step S40).

The image-forming-apparatus control section 100 transmits the signal indicating that the sheet whose sheet ID is "2b" has been discharged to the conveyance unit apparatus 6, with respect to the conveyance unit apparatus 6 (Step S41). The conveyance-unit-apparatus control section 600 transmits the signal indicating the discharge of the sheet whose sheet ID is "2b" to the second finishing apparatus 4 (Step S42).

The second-finishing-apparatus control section 400 informs the conveyance unit apparatus 6 of completion of discharge of the sheet whose sheet ID is "2b" (Step S43). The conveyance-unit-apparatus control section 600 informs the image forming apparatus 1 of completion of discharge of the sheet whose sheet ID is "2b" (Step S44).

As described above, according to the image forming system of the present embodiment, when the number of sets is plural according to the job to be executed and a plurality of finishing apparatuses which can perform finishings corresponding to the job are connected to the conveyance unit apparatus, it is judged which of the finishing apparatuses should perform finishing to each sheet. Since the conveyance unit apparatus performs the control to discharge the sheets to the judged finishing apparatuses, even when the speed of continuous printing of the image forming apparatus is faster than the processing speed of the finishing apparatus, finishings can be shared so that productivity of continuous printing is improved. Moreover, even when sheet-jam occurs in one finishing apparatus, other apparatuses can perform finishings so that downtime is reduced.

By judging which of the finishing apparatuses should performs finishing to each sheet on the basis of the number of sets and the speed of continuous printing of the image forming apparatus, even when the multiple sets are to be output, the finishings can be distributed optimally. By performing this distribution uniformly depending on the number of the finishing apparatuses, productivity can be improved without stopping continuous printing of the image forming apparatus.

When the speed of continuous printing of the image forming apparatus exceeds the processing speed of the finishing apparatuses, by executing the wait processing in a predetermined condition, finishing can be performed so as to be suited to a given situation. The wait processing may be performed similarly even when the remaining number of sets according to the job is not equal to or above the number of the finishing apparatuses.

Since the information for identifying the finishing apparatus which should perform finishing can be contained in the sheet ID, the conveyance unit apparatus can judge which of the finishing apparatuses should discharge the sheets on the basis of the sheet ID.

Incidentally, the description of the above-mentioned embodiment is an example of the preferred image forming system according to the present invention, and the present invention is not limited to that. For example, as other computer readable media other than the storage section of the present embodiment, a nonvolatile memory including a Secure Digital (SD) card and a flash memory such as a Universal Serial Bus (USB) memory, and a portable recording medium such as CD-ROM may be applied to the present invention. It is also possible to superimpose various pieces of data such as data of the programs and audio data on carrier wave to provide it via the communication line.

In addition, also detailed operations of the image forming system can be change appropriately without departing from the spirit of the present invention.

All of the disclosures including the claims, the patent specification, the attached drawings and the abstract of Japanese Patent Application No. 2009-158350 filed on Jul. 3, 2009 are herein incorporated by reference.

What is claimed is:

1. An image forming system comprising:

an image forming apparatus which forms an image on a sheet;

a plurality of finishing apparatuses each of which is configured to perform finishing to the sheet on which the image is formed by the image forming apparatus and discharge the sheet; and a conveyance unit apparatus to which each of the image forming apparatus and the plurality of finishing apparatuses is connected;

wherein the image forming apparatus includes a control section which judges as to which of the plurality of finishing apparatuses performs the finishing to the sheet and which transmits a judgment result to the conveyance unit apparatus, when a number of sets to be output according to a job to be executed is plural and when a given plurality of the finishing apparatuses, each of which can perform finishing corresponding to the job, are connected to the conveyance unit apparatus, wherein the conveyance unit apparatus includes:

a plurality of placement sections in which the plurality of finishing apparatuses can be placed respectively, a conveyance path along which the sheet on which the image is formed by the image forming apparatus is conveyed, a plurality of discharging sections which are respectively provided in the placement sections, wherein the plurality of discharging sections are configured to discharge the sheet conveyed along the conveyance path to corresponding finishing apparatuses placed in the placement sections, one or more discharging-section switching sections among which a discharging-section switching section, corresponding to a discharging section discharging the sheet conveyed along the conveyance path among the plurality of discharging sections, is switched, and a control section which judges the discharging section as discharging the sheet based on the judgment result received from the control section of the image forming apparatus and which switches the discharging-section switching section so that the sheet is discharged to the judged discharging section, and wherein the control section of the image forming apparatus is configured to perform wait processing to stop image formation during a predetermined time between image forming processing for each of a plurality of sheets to be printed sequentially, when a speed of continuous printing of the image forming processing exceeds a processing speed of the given finishing apparatuses connected to the conveyance unit apparatus, and when a remaining number of sets is not equal to or above a number of the given finishing apparatuses connected to the conveyance unit apparatus.

2. The image forming system of claim 1, wherein the control section of the image forming apparatus judges which of the plurality of finishing apparatuses performs the finishing based on the speed of continuous printing of the image forming apparatus and the number of sets to be output according to the job to be executed.

3. The image forming system of claim 2, wherein the control section of the image forming apparatus distributes printed sheets corresponding to the number of sets uniformly to the given plurality of finishing apparatuses each of which is connected to the conveyance unit apparatus and performs the finishing.

4. The image forming system of claim 1, wherein the control section of the image forming apparatus transmits the judgment result to the conveyance unit apparatus by including the judgment result in a sheet ID which is uniquely given to each sheet on which the image is to be formed, and transmitting the sheet ID to the conveyance unit apparatus, and wherein the control section of the conveyance unit apparatus judges as to which of the discharging sections each sheet is to be discharged to based on the received sheet ID for each sheet and which switches the discharging-section switching section so that each sheet is discharged to the judged discharging section.

5. The image forming system of claim 1, wherein the control section of the image forming apparatus determines which finishing apparatuses performs the finishing among the plurality of finishing apparatuses connected to the conveyance unit apparatus in an order of the finishing apparatuses from closest to farthest to/from the image forming apparatus.

* * * * *